US008991355B2

(12) United States Patent
Xie et al.

(10) Patent No.: US 8,991,355 B2
(45) Date of Patent: Mar. 31, 2015

(54) CYLINDER HEAD OF SMALL-SIZED GENERAL-PURPOSE GASOLINE ENGINE AND GASOLINE ENGINE HAVING THE SAME

(75) Inventors: Yuming Xie, Chongqing (CN); Hongbo Chen, Chongqing (CN); Bing Liu, Chongqing (CN); Ju Lei, Chongqing (CN)

(73) Assignee: Loncin Motor Co., Ltd. (CN)

( * ) Notice: Subject to any disclaimer, the term of this patent is extended or adjusted under 35 U.S.C. 154(b) by 269 days.

(21) Appl. No.: 13/496,700

(22) PCT Filed: Dec. 28, 2011

(86) PCT No.: PCT/CN2011/084810

§ 371 (c)(1), (2), (4) Date: Mar. 16, 2012

(87) PCT Pub. No.: WO2013/078747

PCT Pub. Date: Jun. 6, 2013

(65) Prior Publication Data

US 2012/0255515 A1 Oct. 11, 2012

(30) Foreign Application Priority Data

Dec. 1, 2011 (CN) ..... 2011 1 0393282

(51) Int. Cl.
*F01L 1/18* (2006.01)
*F02F 1/24* (2006.01)

(52) U.S. Cl.
CPC ..... *F02F 1/24* (2013.01); *F02F 2001/245* (2013.01)
USPC ..... 123/193.5; 123/90.39

(58) Field of Classification Search
USPC ..... 123/664–666, 193, 5, 90.36, 90.39, 123/193.5, 19.35, 90.33
See application file for complete search history.

(56) References Cited

U.S. PATENT DOCUMENTS 1,531,298 A * 3/1925 Manville ..... 123/665
2,942,594 A * 6/1960 Turlay ..... 123/54.7

(Continued)

FOREIGN PATENT DOCUMENTS

CN 1204004 A 1/1999
CN 200999663 1/2008

(Continued)

OTHER PUBLICATIONS

International Search Report corresponding to PCT/CN2011/084810 mailed Sep. 13, 2012, 4 pages.

*Primary Examiner* — Marguerite McMahon
(74) *Attorney, Agent, or Firm* — Cantor Colburn LLP

(57) ABSTRACT

The invention discloses a cylinder head of a small-sized general-purpose gasoline engine and a gasoline engine having the same. The cylinder head of the small-sized general-purpose gasoline engine comprises a cylinder head body (1), and an intake passage (9), an exhaust passage (5) and a sparking plug mounting hole (8) arranged on the cylinder head body (1); a combustion chamber surface (7), being a arched smooth curve, is formed at the inner side of the cylinder head body (1); the cylinder head body (1) is provided with an intake valve (11) corresponding to the intake passage (9) and an exhaust valve (4) corresponding to the exhaust passage (5); the intake valve (11) is inclined towards the intake passage (9) from the bottom part to the top part; the exhaust valve (4) is inclined towards the exhaust passage (5) from the bottom part to the top part; and the included angle between the axis of the intake valve (11) and the axis of the exhaust valve (4) is 24±5 degrees. In the invention, the parameters between the combustion chamber and the intake valve as well as the exhaust valve are inter-coordinated and matched, the operation efficiency of the gasoline engine is improved, the fuel is saved, and the discharge is reduced.

8 Claims, 3 Drawing Sheets

(56) References Cited

U.S. PATENT DOCUMENTS

| | | | | |
|---|---|---|---|---|
| 5,101,778 | A | 4/1992 | Fukuo et al. | |
| 5,325,825 | A * | 7/1994 | Schmidt et al. | 123/90.39 |
| 5,826,567 | A * | 10/1998 | Sakaguchi et al. | 123/666 |
| 5,967,105 | A * | 10/1999 | Freeland | 123/90.43 |
| 6,070,561 | A * | 6/2000 | Greene et al. | 123/90.36 |
| 6,244,231 | B1 | 6/2001 | Kouchi et al. | |
| 6,615,781 | B2 * | 9/2003 | Tanaka et al. | 123/90.27 |
| 2005/0172925 | A1 * | 8/2005 | Kurosawa | 123/188.17 |
| 2009/0126665 | A1 * | 5/2009 | Edgar | 123/90.39 |
| 2010/0236504 | A1 * | 9/2010 | Yamazaki | 123/41.72 |

FOREIGN PATENT DOCUMENTS

| | | | |
|---|---|---|---|
| CN | 201865715 | U | 6/2011 |
| CN | 202001097 | U | 10/2011 |
| CN | 202001128 | U | 10/2011 |
| CN | 202001131 | U | 10/2011 |
| CN | 202031714 | | 11/2011 |
| CN | 202417729 | | 9/2012 |
| EP | 1 484 498 | A1 | 12/2004 |
| JP | 2003129813 | A | 5/2003 |
| JP | 4782098 | | 7/2011 |

* cited by examiner

CYLINDER HEAD OF SMALL-SIZED GENERAL-PURPOSE GASOLINE ENGINE AND GASOLINE ENGINE HAVING THE SAME

TECHNICAL FIELD OF THE INVENTION

The invention relates to general-purpose power machinery, in particular, to a cylinder head of a small-sized general-purpose gasoline engine and a gasoline engine having the same.

BACKGROUND OF THE INVENTION

In addition to the use in vehicles and aircraft, the general-purpose gasoline engine is the reciprocated piston type gasoline engine with extensive use. Generally speaking, the gasoline engine with a power within 20 kW is a small-sized general-purpose gasoline engine that is provided in common use and featured with small volume, low mass, convenient use and operation and low price. As one of the power sources, the general-purpose gasoline engine drives general-purpose machinery, such as forestry plant protection machinery, garden machinery, generator set, building machinery and the like. The general-purpose gasoline engine is power machinery with gasoline as the fuel and is composed of a cylinder, a crank connecting rod mechanism, a gas distribution system, a gasoline supply system, a lubrication system and an ignition system. The cylinder head which provided with an intake passage and an exhaust passage is together with the cylinder to form a combustion chamber surface, thereby the cylinder head is an important component of the gasoline engine. Mixture of the gasoline as fuel and air is burnt in the combustion chamber so as to generate plenty of heat energy to be as the driving energy. The intake and exhaust of the combustion chamber as well as the parameters of the combustion chamber are necessary to guarantee the high-efficient operation of the gasoline engine.

In the prior art, the combustion chamber surface of the cylinder head usually adopts a wedge-shaped structure so that a high surface to volume ratio can be obtained. The structure is good for the installation of the other auxiliary structures, such as valve assemblies. If the combustion chamber surface structure is changed, the arrangement of the intake valve assemblies and the exhaust valve assemblies thereby is affected. In order to solve said problems, a spherical combustion chamber structure with small surface to volume ratio and good influence to the performance of the gasoline engine is provided. In order to adapt to the spherical combustion chamber structure, the intake valve and the exhaust valve are arranged obliquely. However, the combustion chamber structure is only one of the key structures which affect the operation of the gasoline engine; the intake and exhaust parameters of the intake valve and the exhaust valve also have a significant influence to the work efficiency and the discharge of the gasoline engine. Only By the adoption of the spherical combustion chamber and the obliquely arranged valve structures, the efficiency or the discharge of the gasoline engine does not necessarily to be improved.

At the present stage, along with the gradually increasing global environmental requirements, for example, the requirements for the discharge of the small-sized general-purpose gasoline engine in America reach to the standard of third stage of US Environmental Protection Agency (for short, EPA3), in order to meet the standard, a catalytic converter is necessary according to the technical condition of the existing cylinder head. For the small-sized general-purpose gasoline engine, light and convenient structure, flexibility, low production cost and low use cost thereof are the advantages to occupy the market, but the use of the external purification means, such as the catalytic converter, may obviously cause a cost increase of the gasoline engine for the middle- and small-sized gasoline engine, which makes said gasoline engine lose the competitive advantage in the market as well as cause the increase of the volume and weight which makes the gasoline engine lose the advantages of handiness and flexibility. Moreover, for the catalytic converter as an external purification means, the combustion efficiency of the engine body will not be improved, and the waste gas is processed passively; and for the energy, the purpose of conservation and rational use is not realized, but the great increase of the use cost and the maintenance cost may be caused.

Therefore, an improvement for the combustion chamber surface of the cylinder head of the gasoline engine is needed, a change is made for the parameter corresponding relationship among the combustion chamber, the intake valve and the exhaust valve in the prior art, and the parameters are inter-coordinated and matched so that it is better for the mixing and combustion of the combustion gas, the improvement of the operation efficiency of the gasoline engine, the conservation of the fuel, and the reduction of the discharge. Without using the external purifying means, such as the catalytic converter, the discharge index thereof can reach to, even far higher than the requirements of the standard of the EPA3 stage. Meanwhile, the gasoline engine can keep the advantages of low cost, flexibility as well as low and convenient use and is in accordance with the market demand.

SUMMARY OF THE INVENTION

In view of the above, the invention provides a cylinder head of a small-sized general-purpose gasoline engine and a gasoline engine having the same, which changes the parameter corresponding relationship among the combustion chamber, the intake valve and the exhaust valve in the prior art, inter-coordinates and matches the parameters so that it is better for the mixing and combustion of the combustion gas, the improvement of the operation efficiency of the gasoline engine, the conservation of the fuel, and the reduction of the discharge. Without using the external purifying means, such as the catalytic converter, the discharge index thereof can reach to, even far higher than the requirements of the standard of the EPA3 stage. Meanwhile, the gasoline engine can keep the advantages of low cost, flexibility as well as low cost and convenient use and is in accordance with the market demand.

The cylinder head of the small-sized general-purpose gasoline engine disclosed by the invention comprises a cylinder head body and an intake passage, an exhaust passage as well as a sparking plug mounting hole that are arranged on the cylinder head body. A combustion chamber surface is formed at the inner side of the cylinder head body; the combustion chamber surface is an arched smooth curve; the cylinder head body is provided with an intake valve corresponding to the intake passage and an exhaust valve corresponding to the exhaust passage. The intake valve is inclined towards the intake passage side from the bottom part to the top part; the exhaust valve is inclined towards the exhaust passage from the bottom part to the top part; and the included angle between the axis of the intake valve and the axis of the exhaust valve is 24±5 degrees.

Furthermore, the edge of the combustion chamber surface is in a round shape having the same diameter as the diameter of the cylinder and being concentric with the cylinder. By matching between the inner diameter of the edge of the combustion chamber surface and the inner diameter of the cylinder block, and by combining the combustion chamber surface structure and the included angle between the axis of the intake valve and the axis of the exhaust valve, the mixing and combustion of the mixed gas can be further strengthened, the combustion efficiency can be improved, and the discharge can be reduced; and by adapting to the combustion chamber with smooth curve and the included angle between the intake valve and the intake passage and between the exhaust valve and the exhaust passage, it is convenient to organize the intake and exhaust, delete the dead corner and the accumulated carbon, improve the intake and exhaust efficiencies and eliminate the disadvantages that the existing combustion chamber structure is bad for the intensive mixing of the combustion gas, thereby reducing the mixing efficiency and affecting the combustion and discharge.

Furthermore, the transverse central line and the lengthways central line of the combustion chamber surface are the are lines with the radians of 68±2 degrees; the curve positioned among the transverse central line of the combustion chamber surface, the lengthways central line of the combustion chamber surface, the intersecting line of the intake valve and the combustion chamber surface, the intersecting line of the exhaust valve and the combustion chamber surface and the end surface line of the combustion chamber surface is formed in a sweeping manner; and the included angle between the axis of the intake valve and the axis of the exhaust valve is 24 degrees. The included angle is combined with the combustion chamber surface structure in said structure to influence each other and form better parameter matching so that it is convenient to organize the intake rolling flow and intake eddy, increase the airflow disturbance in the cylinder, speed up the combustion; the combustion is more sufficiently so as to be good for the combustion, the reduction of the discharge of CH+NO and the power increase of the gasoline engine. Meanwhile, the included angles between the intake valve and the intake passage and between the exhaust valve and the exhaust passage are smaller than the combustion chamber surface of the other structures, so the resistances of intake and exhaust are reduced efficiently, the intake and exhaust become more smoothly, and the power of the gasoline engine is improved efficiently. The fuel consumption rate and discharge are further reduced; the driving energy is saved; the power can be improved by more than 250 W; the fuel consumption rate is reduced by about 8%; and the exhaust reaches to 5.5 g/kW.h, which exceeds the standard of the EPA3 stage.

Furthermore, the axis of the intake valve and the axis of the exhaust valve are respectively vertical to the tangent plane of the combustion chamber surface at the respective intersecting point. That is to say, the axes of the intake valve and the exhaust valve are intersected with the central line of the combustion chamber surface that is overlapped with the central line of the cylinder diameter. For the adaptation to the intake and exhaust directions of the combustion chamber, the resistance is reduced, the dynamic property of the gasoline engine is enhanced, and the discharge can be further reduced. The gasoline engine that combines the combustion chamber surface of such structure with the angle of the intake valve and the exhaust valve has high dynamic test efficiency, reduces the generation of residual gas, thereby obtaining low discharge, and reduces the fuel consumption by over 9%; and the improvement of the gasoline engine power is 250 W or more than the existing spherical combustion chamber. Furthermore, the intake valve and the exhaust valve are respectively provided with a rocker arm; the cylinder head body is provided with two rocker arm bases in one-to-one correspondence with the two rocker arms; the two rocker arms are respectively provided with embedding grooves that allow the insertion of the top parts of the corresponding rocker arms; the two rocker arms are hinged in a manner of single freedom degree to the top part of the corresponding rocker arm base respectively through the rockshaft that permeates through the two sidewalls of the corresponding embedding groove so as to form lever structures with the corresponding rockshafts as the pivot points. The rocker arm is hinged through the structure in which, the embedding groove is arranged on the rocker arm so that the transverse size of the rocker arm base is reduced greatly and a small space is occupied. The rocker arm is adaptable to the engine with small volume and small displacement to avoid the structure that is unsuitable for the installation and fixing of the hinged structure between the rocker arm and the rocker arm base, due to the small area of the cylinder head of the engine; the rocker arm has low vibration movement or rocking movement amount in each direction during the operational process to guarantee good sealing performance of the intake valve and the exhaust valve assemblies after being closed and smooth motion and to guarantee the normal operation of the gasoline engine; no condition that the direction of the stressed force when the valves are opened or closed is inconsistent with the movement direction occurs so that the sealing effect is ensured, the efficiency is thereby improved, the energy and the arrangement space are saved, the failure rate of the rocker arm is reduced efficiently, and the maintenance cost is also reduced. The rocker arm is arranged rationally to adapt to the intake and exhaust positions; it is good for guaranteeing the valve timing and the gas distribution phase, thereby improving the performance and reducing the discharge.

Furthermore, planes, respectively flushed with the inner end part of a retainer of the intake valve and the inner end part of the retainer of the exhaust valve and positioned around the retainer of the intake valve and the retainer of the exhaust valve are arranged on the combustion chamber surface; and the edge of the combustion chamber surface is adaptable to the curve between the near points of the intake valve and the exhaust valve so as to form a partial recess. The removal of the steps results in a decrease of the interference to the air intake and the exhaust, a reduction of the resistance and a removal of the dead corner as well as the shape mutation, and guarantees the sufficient combustion of the mixed gas and improves the efficiency of the gasoline engine. For the mounting structure of the intake valve and the exhaust valve as well as the corresponding angle, the near point positioned at the edge of the combustion chamber surface needs to sink so as adaptively form a recess at the combustion chamber surface.

Furthermore, the two rockshafts are arranged obliquely inwards the top part along the radial direction, with respect to the mounting surface of the cylinder head body; the inclination angle of the rockshaft, relative to the mounting surface of the cylinder head body is the same as the inclination angles of the intake valve and the exhaust valve, relative to the axial direction of the cylinder block. The obliquely arranged rockshaft can adapt to the obliquely arranged valve structure and the geometry of the spherical combustion chamber so that it is good for guaranteeing the coordination and sealing performance of the motion of the valves driven by the rocker arm and the smooth driving.

Furthermore, the axis of the intake valve and the axis of the exhaust valve are symmetrical to each other along the central line in the axial direction of the cylinder block, relative to the combustion chamber surface. The distribution structure of the intake valve and the exhaust valve is adaptable to the combustion chamber surface so as to reach to the best matching of the structure parameters. The gasoline engine combining the combustion chamber surface in the proportion with the angles of the intake valve and the exhaust valve has highest power test efficiency and lowest discharge, reduces the fuel consumption by 9% or more; in comparison with the existing spherical combustion chamber, the improvement of the gasoline engine power is improved by 250 W or more; and the discharge reaches to 5.3 g/kW.h.

Furthermore, the embedding grooves on the two rocker arms are through grooves; and the top parts of the two rocker arm bases are exposed through the corresponding embedding grooves and are respectively provided with lubrication oil holes running through the rockshaft.

The invention also discloses a gasoline engine with cylinder head of the aforesaid small-sized general-purpose gasoline engine, wherein the cylinder head of the small-sized general-purpose gasoline engine is mounted on the gasoline engine.

The beneficial effects of the invention are as follows: the cylinder head of the small-sized general-purpose gasoline engine and the gasoline engine having the same adopt the combustion chamber surface in arched smooth curve structure with a spherical surface or multiple spherical surfaces to change the parameter corresponding relationship between the combustion chamber and the intake valve as well as the exhaust valve in the prior art while reducing the surface to volume ratio so that the parameters are coordinate and matched; the rational selection of the surface to volume ratio is better for the mixing and combustion of the burning gas, the improvement of the operating efficiency of the gasoline engine, the conservation of the fuel and the reduction of the discharge; without the use of the external purification means, such as the catalytic converter, the discharge index can reach to and far higher than the requirements of the standard of the EPA3 stage; meanwhile, the gasoline engine can keep the advantages of low cost, flexibility and handiness, and meet with the market requirements.

When the surface to volume ratio of the combustion chamber surface is further reduced, the invention rationally matches the angles of the intake valve and the exhaust valve so that the included angles between the intake valve and the intake passage and between the exhaust valve and the exhaust passage are smaller than the combustion chamber surface in other structures; the intake and exhaust resistances are reduced efficiently so that the intake and exhaust are smoother; the power of the gasoline engine is improved efficiently so that it is further good for reducing the fuel consumption rate and the discharge. The power can be improved by more than 250 W; the fuel consumption rate is reduced by 9%; the lowest discharge reaches to 5 g/kW.h, which exceeds the standard of the 8 g/kW.h at the EPA3 stage. From this, the improvement of the power of the gasoline engine and the reduction of the discharge thereof are obvious.

The cylinder head of the invention is used in a small-sized general-purpose gasoline engine to save the energy and reduce the consumption.

BRIEF DESCRIPTION OF THE DRAWINGS

The invention is described below with reference to the accompanying drawings and embodiments in detail.

DETAILED DESCRIPTION OF THE INVENTION

Figure 1:
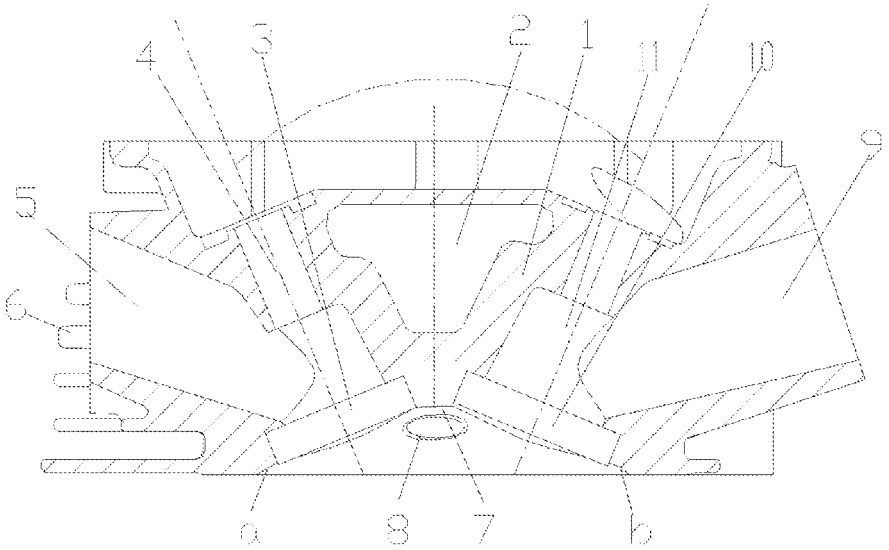
FIG. 1 shows a schematic diagram of a combustion chamber and valve arrangement structure of a cylinder head of the invention.
Figure 2:
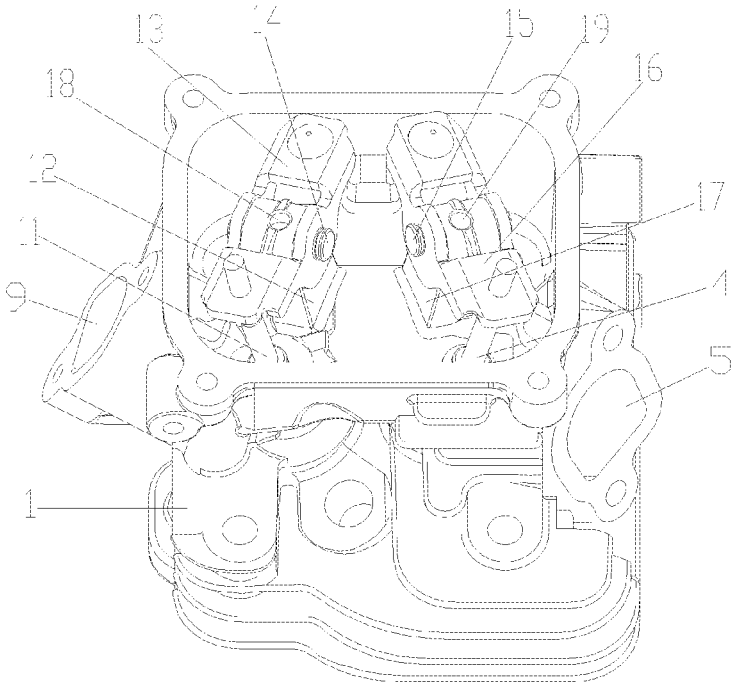
FIG. 2 shows a schematic diagram of an arrangement structure of a rocker arm of a cylinder head of the invention.
Figure 3:
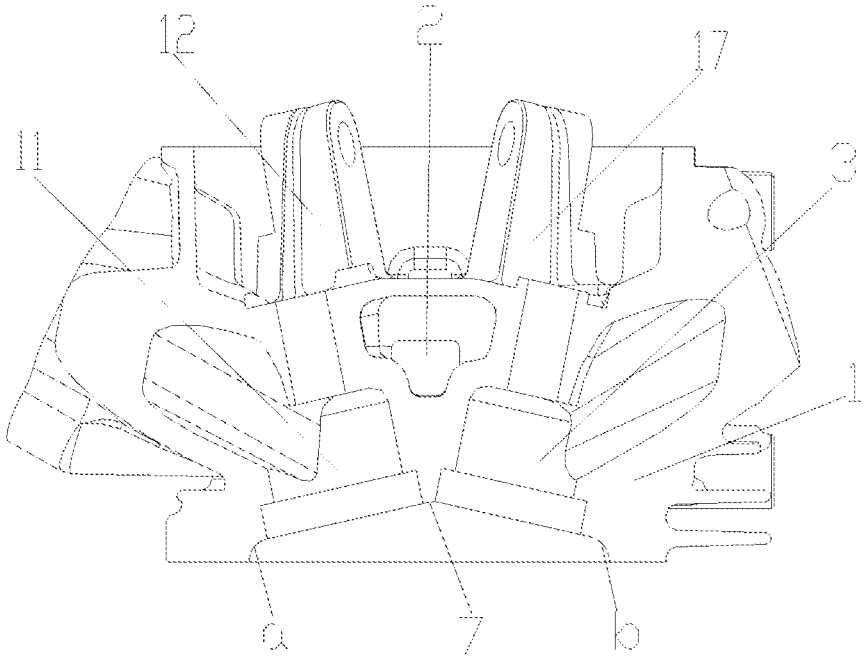
FIG. 3 shows a schematic diagram of an arrangement structure of a rocker arm base of the invention.
Figure 4:
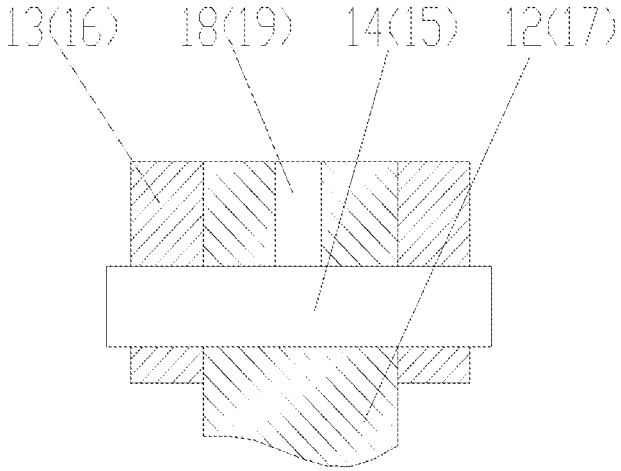
FIG. 4 shows a matched cross section view of a rockshaft and a rocker arm base.
Figure 5:
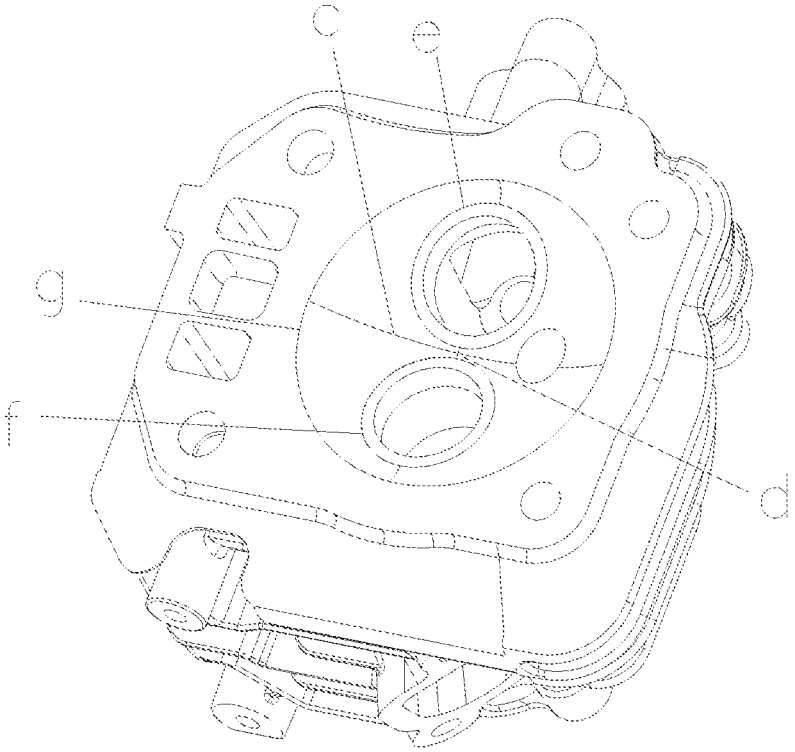
FIG. 5 is a schematic diagram of a combustion chamber surface of a cylinder head.

The FIG. 1 shows a schematic diagram of a combustion chamber and valve arrangement structure of a cylinder head of the invention; the FIG. 2 shows a schematic diagram of an arrangement structure of a rocker arm of a cylinder head of the invention; the FIG. 3 shows a schematic diagram of an arrangement structure of a rocker arm base of the invention; the FIG. 4 shows a matched cross section view of a rockshaft and a rocker arm base; the FIG. 5 is a schematic diagram of a combustion chamber surface of a cylinder head. As shown in the figures, the cylinder head of a small-sized general-purpose gasoline engine of the embodiment comprises a cylinder head body 1, and an intake passage 9, an exhaust passage 5 and a sparking plug mounting hole 8 arranged on the cylinder head body 1; a combustion chamber surface 7, being a arched smooth curve is formed at the inner side of the cylinder head body 1; here, the arched smooth curve includes a arched surface which comprises a spherical surface and composite spherical surface, and a arched surface which is composed of smooth curves such as a parabola and a hyperbola; the cylinder head body 1 is provided with an intake valve 11 corresponding to the intake passage 9 and an exhaust valve 4 corresponding to the exhaust passage 5; the intake valve 11 is inclined towards the intake passage 9 from the bottom part to the top part; the exhaust valve 4 is inclined towards the exhaust passage 5 from the bottom part to the top part; and the included angle $\alpha$ between the axis of the intake valve 11 and the axis of the exhaust valve 4 is 24±5 degrees.

In the embodiment, the edge of the combustion chamber surface 7 is in a round shape having the same diameter as the cylinder diameter and being concentric with the cylinder. The edge is the intersecting line of the combustion chamber surface 7 and the end surface where the cylinder head body 1 and the cylinder block are connected. By matching between the inner diameter of the edge of the combustion chamber surface and the inner diameter of the cylinder block, and by combining the structure of the combustion chamber surface 7 and the included angle between the axis of the intake valve 11 and the axis of the exhaust valve 4, the mixing and combustion of the mixed gas can be further strengthened, the combustion efficiency can be improved, and the discharge can be reduced; and by adapting to the combustion chamber with smooth curve and the included angle between the intake valve and the intake passage and between the exhaust valve and the exhaust passage, it is convenient to organize the intake and exhaust, delete the dead corner and the accumulated carbon, improve the intake and exhaust efficiencies and eliminate the disadvantages that the existing combustion chamber structure is bad for the intensive mixing of the combustion gas, thereby reducing the mixing efficiency and affecting the combustion and discharge.

In the embodiment, the transverse central line d and the lengthways central line c of the combustion chamber surface 7 are the arc lines with the radians of 68±2 degrees; the transverse central line d is in the same direction as the connecting line that connects the central line of the intake valve 11 with the central line of the exhaust valve 4; and the lengthways central line c is in the direction vertical to the connecting line that connects the central line of the intake valve 11 and the central line of the exhaust valve 4. The curve positioned among the transverse central line d of the combustion chamber surface, the lengthways central line c of the combustion chamber surface, the intersecting line e of the intake valve 11 and the combustion chamber surface, the intersecting line f of the exhaust valve 4 and the combustion chamber surface and the end surface line g of the combustion chamber surface are formed in a sweeping manner. The included angle between the axis of the intake valve 11 and the axis of the exhaust valve 4 is 24 degrees. The sweeping means that the expected curve is obtained by using the sweeping function of a map-making software (such as a three-dimensional software). The included angle is combined with the combustion chamber surface structure in said structure to influence each other and form better parameter matching so that it is convenient to organize the intake rolling flow and intake eddy, increase the airflow disturbance in the cylinder, speed up the combustion; the combustion is more sufficiently so as to be good for the combustion, the reduction of the discharge of CH+NO and the power increase of the gasoline engine. Meanwhile, the included angles between the intake valve and the intake passage and between the exhaust valve and the exhaust passage are smaller than the combustion chamber surface of the other structures, so the resistances of intake and exhaust are reduced efficiently, and the intake and exhaust become smoother. The power of the gasoline engine is improved efficiently; the fuel consumption rate and discharge are further reduced; the driving energy is saved; the power can be improved by more than 250 W; the fuel consumption rate is reduced by about 8%; and the exhaust reaches to 5.5 g/kW.h, which exceeds the standard of the EPA3 stage.

In the embodiment, the axis of the intake valve 11 and the axis of the exhaust valve 4 are respectively vertical to the tangent plane of the combustion chamber surface 7 at the respective intersecting point. That is to say, the axes of both the intake valve 11 and the exhaust valve 4 are intersected with the central line of the combustion chamber surface 7 that is overlapped with the central line of the cylinder diameter. For the adaptation to the intake and exhaust directions of the combustion chamber, the resistance is reduced, the dynamic property of the gasoline engine is enhanced, and the discharge can be further reduced. The gasoline engine that combines the combustion chamber surface of such structure with the angle of the intake valve and the exhaust valve has high dynamic test efficiency, reduces the generation of residual gas, thereby obtaining low discharge, and reduces the fuel consumption by over 9%; and the improvement of the gasoline engine power is 250 W or more than the existing spherical combustion chamber.

In the embodiment, the intake valve 11 and the exhaust valve 4 are respectively provided with rocker arms (an intake valve rocker arm 13 and an exhaust valve rocker arm 16 as shown in the figures); the cylinder head body 1 is provided with two rocker arm bases (an intake valve rocker arm base 12 and an exhaust valve rocker arm base 17) in one-to-one correspondence with the two rocker arms (an intake valve rocker arm 13 and an exhaust valve rocker arm 16); the two rocker arms (an intake valve rocker arm 13 and an exhaust valve rocker arm 16) are respectively provided with embedding grooves that allow the insertion of the top parts of the corresponding rocker arm base; the two rocker arms (the intake valve rocker arm 13 and the exhaust valve rocker arm 16) are hinged in a manner of single freedom degree to the top part of the corresponding rocker arm base (the intake valve rocker arm base 12 and the exhaust valve rocker arm base 17) respectively through the rockshaft (an intake valve rockshaft 14 and an exhaust valve rockshaft 15) that permeates through the two sidewalls of the corresponding embedding groove so as to form lever structures with the corresponding rockshafts (the intake valve rockshaft 14 and the exhaust valve rockshaft 15) as the pivot points. As shown in the figure, the power points of the two lever structures are driven by the respective ejector rods; the resistance points of the two lever structure are correspondingly used for opening or closing the intake valve 11 or the exhaust valve 4 so as to form a steady driving structure; in order to reduce the rotation resistance, the embedding grooves on the two rocker arms (the intake valve rocker arm 13 and the exhaust valve rocker arm 16) are through grooves; the top parts of the two rocker arm bases (the intake valve rocker arm base 12 and the exhaust valve rocker base 17) are exposed through the corresponding embedding groove and are respectively provided with lubrication oil holes that run through the rocker arm shaft (the lubrication oil hole 18 for the intake rocker arm base and the lubrication oil hole 19 of the exhaust rocker base in the FIG. 5). The lubrication oil holes on the intake valve rocker arm base 12 and the exhaust valve rocker base 17 (a lubrication oil hole 18 of the intake rocker arm base and a lubrication oil hole 19 of the exhaust rocker arm base) are used for causing the lubrication oil to enter into the friction surfaces between the intake valve rocker arm shaft 14 and the intake valve rocker arm base 12 and between the exhaust valve rocker arm shaft 15 and the exhaust valve rocker arm base 17 so as to reduce the friction coefficient and increase the operation precision and stability of the rocker arm. As the rocker arm is hinged through the structure in which the rocker is provided with the embedding groove, the transverse size of the rocker arm base can be reduced greatly and occupied space is reduced. The rocker arm is adaptable to the engine with small volume and small displacement so as to avoid the structure that is unsuitable for the installation and fixing of the hinged structure of rocker arm and the rocker arm base. The rocker arm of the invention has low vibration movement or rocking movement amount in each direction during the operational process so that the fault rate of the rocker arm is reduced efficiently, and the maintenance cost is reduced. The rocker arm is arranged rationally to adapt to the intake and exhaust positions, so it is good for guaranteeing the valve timing and the gas distribution phase, thereby improving the performance and reducing the discharge.

In the invention, planes, respectively flushed with the inner end part of a retainer 10 of the intake valve 11 and the inner end part of the retainer 3 of the exhaust valve 4 and positioned around the retainer 10 of the intake valve 11 and the retainer 3 of the exhaust valve 4 are arranged on the combustion chamber surface 7; and the edge of the combustion chamber surface 7 is adaptable to the curve between the near points of the intake valve 11 and the exhaust valve 4 so as to form a partial recess, specifically the recess a and the recess b as shown in the FIG. 1 and FIG. 3. The near points are the points of proximity. The structure removes the steps, reduces the interference to the intake and the exhaust, decreases the resistance, removes the dead corner as well as the shape mutation, guarantees the sufficient combustion of the mixed gas and improves the efficiency of the gasoline engine. For the mounting structure of the intake valve and the exhaust valve as well as the corresponding angles, the near point positioned at the edge of the combustion chamber surface needs to sink so as adaptively form a recess at the combustion chamber surface.

In the embodiment, the two rockshafts (the intake valve rockshaft 14 and the exhaust valve rockshaft 15) are arranged obliquely inwards the top part along the radial direction, with respect to the mounting surface of the cylinder head body; the radial inward direction is the direction from the circumference of the cylinder head to the radial central line; and the inclination angle of the rockshaft (the intake valve rockshaft 14 and the exhaust valve rockshaft 15), relative to the mounting surface of the cylinder head body is the same as the inclination angles of the intake valve and the exhaust valve, relative to the axial direction of the cylinder block. The obliquely arranged rockshafts (the intake valve rockshaft 14 and the exhaust valve rockshaft 15) can adapt to the obliquely arranged valve structure and the geometry of the spherical combustion chamber so that it is good for guaranteeing the coordination and sealing performance of the motion of the valves driven by the rocker arm as well as the smooth driving. Meanwhile, in order to adapt to the inclination angles of the intake valve and the exhaust valve, the two rocker arm bases (the intake valve rocker arm base 12 and the exhaust valve rocker base 17) are arranged obliquely and oppositely along the radial direction and have good adaptability; and thereby, the cylinder head structure is more compact.

In the embodiment, the axis of the intake valve 11 and the axis of the exhaust valve 4 are symmetrical to each other along the central line in the axial direction of the cylinder block, relative to the combustion chamber surface 7. The distribution structure of the intake valve and the exhaust valve is adaptable to the combustion chamber surface so as to obtain the best matching of the structure parameters. The gasoline engine combining the combustion chamber surface in the proportion with the angles of the intake valve and the exhaust valve has the highest power test efficiency and the lowest discharge, reduces the fuel consumption by 9% or more; and in comparison with the existing spherical combustion chamber, the improvement of the gasoline engine power is improved by 250 W or more, and the discharge reaches to 5.3 g/kW.h.

In the embodiment, the cylinder head body 1 is provided with a through sparking plug air-cooling passage 2 that is positioned at the sparking plug mounting hole 8. The sparking plug and the cylinder block are well cooled through the air-cooling; and the problem that service life is reduced due to the high temperature of the sparking plug in the prior art is avoided.

In the embodiment, radiating ribs 6 are arranged at the outer surface of the cylinder head body 1; and the radiating ribs 6 extend to the outer wall of the exhaust passage 5. The exhaust temperature is reduced efficiently; the tail gas processing components in the exhaust system are protected; the discharge is further reduced; and the environment can be protected.

The invention also discloses a gasoline engine with cylinder head of the aforesaid small-sized general-purpose gasoline engine. The cylinder head of the small-sized general-purpose gasoline engine is mounted to the gasoline engine. The gasoline engine is applied to the general-purpose machinery, including forestry plant protection machinery, garden machinery, generator set, building machinery and the like.

While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

The invention claimed is:

1. A cylinder head of a small-sized general-purpose gasoline engine, comprising:

a cylinder head body (1), an intake passage (9), an exhaust passage (5) and a sparking plug mounting hole (8) arranged on the cylinder head body (1), wherein a combustion chamber surface (7), being a arched smooth curve, is formed at the inner side of the cylinder head body (1);

the cylinder head body (1) is provided with an intake valve (11) corresponding to the intake passage (9) and an exhaust valve (4) corresponding to the exhaust passage (5);

the intake valve (11) is inclined towards the intake passage (9);

the exhaust valve (4) is inclined towards the exhaust passage (5); and an included angle between the axis of the intake valve (11) and the axis of the exhaust valve (4) is 24±5 degrees; and wherein the intake valve (11) and the exhaust valve (4) are respectively provided with rocker arms (13, 16);

the cylinder head body (1) is provided with two rocker arm bases (12, 17) which respectively correspond to the two rocker arms (13, 16);

the two rocker arms (13, 16) are respectively provided with embedding grooves that allow insertion of top parts of the two rocker arm bases (12, 17); and the two rocker arms (13, 16) are hinged to the top parts of the two rocker arm bases (12, 17) respectively through rockshafts (14, 15) that pass through two sidewalls of corresponding embedding grooves and corresponding rocker arm bases (12, 17);

wherein a top surface of each embedding groove is provided with a through hole;

the top parts of the two rocker arm bases (12, 17) are exposed through the corresponding through holes and are respectively provided with lubrication oil holes (18, 19) that run through the corresponding rockshafts (14, 15).

2. The cylinder head of the small-sized general-purpose gasoline engine according to claim 1, wherein a rim of the combustion chamber surface (7) is in a round shape having the same diameter as the cylinder and being concentric with the cylinder.

3. The cylinder head of the small-sized general-purpose gasoline engine according to claim 1, wherein the axis of the intake valve (11) and the axis of the exhaust valve (4) are intersected with a central line of the combustion chamber.

4. The cylinder head of the small-sized general-purpose gasoline engine according to claim 1, wherein the axis of the intake valve (11) and the axis of the exhaust valve (4) are symmetrical along the axial central line of the cylinder.

5. A gasoline engine with the cylinder head of the small-sized general-purpose gasoline engine according to claim 1, wherein the cylinder head of the small-sized general-purpose gasoline engine is mounted to the gasoline engine.

6. A gasoline engine with the cylinder head of the small-sized general-purpose gasoline engine according to claim 2, wherein the cylinder head of the small-sized general-purpose gasoline engine is mounted to the gasoline engine.

7. A gasoline engine with the cylinder head of the small-sized general-purpose gasoline engine according to claim 3, wherein the cylinder head of the small-sized general-purpose gasoline engine is mounted to the gasoline engine.

8. A gasoline engine with the cylinder head of the small-sized general-purpose gasoline engine according to claim 4, wherein the cylinder head of the small-sized general-purpose gasoline engine is mounted to the gasoline engine.

* * * * *